US006349433B1

(12) United States Patent
Bouhuijs

(10) Patent No.: US 6,349,433 B1
(45) Date of Patent: Feb. 26, 2002

(54) ASSEMBLY OF A BED AND AN APPARATUS FOR MOVEMENT SUPPORT FOR A PERSON WHEN MOVING INTO OR OUT OF A BED

(75) Inventor: Menno Cornelis Bouhuijs, Hengelo (NL)

(73) Assignee: Prevas Ergonomie B.V., Arnhem (NL)

( * ) Notice: Subject to any disclaimer, the term of this patent is extended or adjusted under 35 U.S.C. 154(b) by 0 days.

(21) Appl. No.: 09/495,698

(22) Filed: Feb. 1, 2000

Related U.S. Application Data

(63) Continuation of application No. 09/043,306, filed as application No. PCT/NL96/00366 on Sep. 19, 1996, now abandoned.

(30) Foreign Application Priority Data

Sep. 19, 1995 (NL) ..... 1001240

(51) Int. Cl.[7] ..... A61G 7/08

(52) U.S. Cl. ..... 5/81.1 R; 5/84.1; 5/87.1; 5/83.1

(58) Field of Search ..... 5/81.1 R, 83.1, 5/85.1, 87.1, 84.1, 89.1

(56) References Cited

U.S. PATENT DOCUMENTS 4,432,359 A * 2/1984 James ..... 128/134
4,847,930 A * 7/1989 Spath ..... 5/84.1
4,932,090 A * 6/1990 Johansson ..... 5/87.1
5,077,844 A * 1/1992 Twitchell et al. ..... 5/87.1
5,560,053 A * 10/1996 Mills ..... 5/81.1 R
5,579,547 A * 12/1996 Hunt ..... 5/83.1

* cited by examiner

*Primary Examiner*—Lynne H. Browne
*Assistant Examiner*—James M. Hewitt

(57) ABSTRACT

Assembly of a bed or similar support and an apparatus for movement support for a person moving into or out of the bed/support. The apparatus has a base part and at least one swivelling arm that is pivotable relative to the base pad about an axis of rotation between at least two positions. The swivelling arm is driven by a motor. Positioning apparatus are provided for disposing the apparatus adjacent the bed/support so that—during use—at least a first pad of the swivelling arm can extend in a first position above a person located on the bed/support and in a second position the first part of the swivelling arm can extend along a person located beside the bed/support. Throughout the path between the first and the second position and vice versa, the swivelling arm can transmit a pulling force to the person in a direction towards the second or first position, as desired, to support his or her movements.

16 Claims, 3 Drawing Sheets

ASSEMBLY OF A BED AND AN APPARATUS FOR MOVEMENT SUPPORT FOR A PERSON WHEN MOVING INTO OR OUT OF A BED

This application is a continuation of Ser. No.: 09/043,306, filed Mar. 18, 1998 which in turn was a 371 of PCT/NL 96/00366, filed Sep. 19, 1996, now abandoned.

BACKGROUND OF THE INVENTION

1. Field of the Invention

The invention relates to an assembly of a bed or like supporting means and an apparatus for movement support for a person when moving into or out of a bed. Such an assembly is known from U.S. Pat. No. 4,932,090.

2. Description of Background Art

For elderly and disabled persons, for instance, it becomes more and more difficult to move into and out of a bed or a like support without using the assistance of another person, for instance a nurse or a member of the family. This has as a drawback that, in the first place, such a helper should always be present when a person is to be moved into or out of bed, which is not always the case and, moreover, is costly if this requires (semi-) professional aid. In addition, the family members are often not physically capable of offering the desired assistance and for the aid-giver, such assistance presents the danger of causing injuries, for instance because of a wrong lifting technique. In the second place, not being able to get out of a bed independently, i.e. without the aid of other people, means a heavy psychological burden to people, because this reduces their sense of self-esteem and will moreover create the feeling of being a burden to others. As a result, people will be moved into or out of bed less often than is desired or desirable, with all its consequences. In the third place, there is the danger that quality of the assistance offered is unsatisfactory, for instance because of incompetence or insufficient power on the part of the aid-giver. This causes the danger of the person in need of help falling or getting injured otherwise.

The known assembly comprises a supporting means and an apparatus for movement support for a person, which apparatus comprises a support bar, mounted by an upstanding support tube. The support bar can be placed in a number of discrete positions, which positions differ in the enclosed angle. A person, sitting or lying down, can grab the support bar and pull himself up into a sitting or standing position. In order to reposition the support bar the user or another person will have to lift the support bar, such that retaining pins extending through the support bar are pulled out of securing slots, after which the support bar can be swivelled to a next position. Then the support bar can be pushed down again, the retaining pin entering a different set of securing slots.

This known assembly has the disadvantage that the user should have sufficient strength to pull himself up into said sitting or standing position, since the full pulling force will have to be exerted by said person. Furthermore, the support bar will give no support to the user during repositioning of the support bar. Therefore, the person will have to stabilize himself before being able to reposition said support bar. This will be hazardous.

From U.S. Pat. No. 4,003,479 a further assembly of a bed or like supporting means and an apparatus for movement support is known, in which during displacement a user is completely carried by the aid. To this end, a large and relatively high support frame is provided from which a rotatable arm is suspended. Provided at the free end of this arm is a support loop in which the user can position himself, after which he can be lifted from the bed entirely and placed in a chair through swivel movement of the arm. Said swivel movement and said lifting is accomplished by means of motor driven elements.

In this apparatus, no effort whatsoever is required from the user during swivelling, while, moreover, the user will not reach a standing position. After all, the supporting apparatus can support him an sitting position only.

This known assembly has the disadvantage that the apparatus is very voluminous and therefore impractical for use in narrow spaces and rather costly. Furthermore, since the aided person does not have to provide for any pulling force or other physical exercise, this known assembly does not provide for exercise for the aided person, nor is this assembly therapeutically valuable. The large apparatus and the complete dependence of the apparatus for the user can be psychologically straining.

The object of the invention is to provide an assembly of a bed or like supporting means and an apparatus for movement support for a person when moving into or out of bed, whereby the above-mentioned drawbacks are avoided. In accordance with the invention, such an assembly is characterized by the features recited in the claims.

With such an assembly, everyone can move into and out of a bed or the like independently, unaided by others and without the risk of injuries. Hence, an assembly according to the invention has substantial physical and psychological advantages to a user.

By using an am that is pivotable relative to a base part, the possibility of a solid grip is provided throughout the movement of the user into or out of a bed, while the arm will always remain in a suitable position relative to the user. The power drive continuously provides the proper power for supporting the movement of the user into the desired position.

During use, the user, when he or she is lying on a bed, pivots the swivelling arm, which may or may not be energized by a motor or otherwise, into the first position so that the first part extends at some distance approximately above the pelvis, transversely across the bed. Then, the swivelling arm is gripped by the hands and the user pulls the upper part of his body slightly towards the swivelling arm. Meanwhile, the motor of the apparatus has started and the swivelling arm swivels in the direction of the second position. Thus, the user can pull himself up further and meanwhile shift in the direction of the edge of the bed, possibly drawn by the swivelling arm. After having moved his legs over the edge of the bed, the user can then pull himself upright by the swivelling arm, which by that time has approximately been brought into the second position. For moving into bed, the user can use the apparatus as well, by following the above steps in reverse order. Moreover, the apparatus can be used for changing a lying position into a sitting position and the other way round. In this manner, the user is supported in his movements by the apparatus.

Also it a user is not able to pull himself up from a lying position into a sitting position, he can use an apparatus according to the invention. After he has gripped a part of the swivelling arm extending above him, the motor can be started, after which the user is drawn into a sitting position by the swivelling arm. From that position, he can then reach the standing position in the above-described manner.

In an advantageous embodiment, an assembly according to the invention is characterized in that the swivelling arm comprises operating means, which, during use of the apparatus, can be operated by the user supported in his or her movement, for controlling the motor for driving the swivelling arm.

The operating means on the Swivelling arm offer the user the possibility of controlling the movements of the swivelling arm during the entire period that he or she moves by means of the apparatus. As a result, the user's safety during use is increased considerably.

Further, it is advantageous if an assembly according to the invention is further characterized in that the swivelling arm comprises at least one bend in the plane of the support surface and the axis of the first part of the swivelling arm between the axis of rotation and the first part so that in the second position, the axis of rotation is located closer to the bed than the first part of the swivelling arm, wherein the first part of the swivelling arm extends approximately along the nearby bed edge at such a distance that a user can stand upright between the bed edge and the first part with his or her hands on the first part.

When such an assembly is used, the user is offered the possibility of holding on to the swivelling arm continuously while still being able to stand upright beside the bed. The bend in the swivelling arm-offers the advantage that the axis of rotation can he located close to the bed, so that space is saved, the forces exerted on the apparatus and the bed are reduced and the accessibility of the bed is not adversely affected, while the first part-of the swivelling arm can, in the second position, still be sufficiently spaced from the bed.

In a preferred embodiment, an assembly according to the invention is characterized in that control means are provided for the motor, whereby the swivelling arm, during use, is driven intermittently so that a period of relatively high speed of rotation is each time alternated by a period of relatively low or no speed of rotation.

During use of the apparatus, the user will have to move across the bed's surface in the direction of the edge. Generally, this will not be a flowing movement. That means that, if the swivelling arm swivels at a constant speed, the user does not have the same pattern of movement as the swivelling arm. As a consequence, the swivelling arm will, with intervals, move away from the user too quickly or, by contrast, not quickly enough. The same problem presents itself if the speed of the swivelling arm is constantly too high or too low. By causing the swivelling arm to move intermittently, it is provided in a simple manner that the patterns of movement of the swivelling arm and the user are adjusted to each other. The pattern of movement can for instance be priorly inputted and be independent of the operating environment, but the apparatus can for instance also comprise sensors whereby, for instance through measurement of force or acceleration, the pattern of movement relative to the user is registered, on the basis of which the motor is then controlled.

In an alternative embodiment, an assembly according to the invention is characterized in that the driving speed of the swivelling arm is controllable by the user.

In this embodiment, the speed of movement of the swivelling arm can readily be controlled by the user, depending on, for instance, his own pattern of movement. Thus, an optimum adjustment between these patterns of movement can be obtained.

It will further be clear that the apparatus can also comprise control and operating means that can be operated by persons other than the user needing help. Moreover, it is preferred that safety means be included which, in the event of calamities such as a swivelling arm rotating too quickly or too far, switch off the apparatus or initiate safety measures otherwise.

In a particularly advantageous embodiment, an assembly according to the invention is characterized in that the positioning means are designed for attaching the apparatus to the bed.

Mounting the apparatus onto the bed offers the advantage that the position of the apparatus is established unequivocally. Accordingly, the path of movement of the swivelling arm relative to the bed is defined as well. Moreover, the bed can then be displaced together with the apparatus, which offers logistic advantages. A further advantage is that for mounting the apparatus, no further measures have to be taken in the environment of the assembly. Moreover, by means of such a method of attachment, the advantage is reached that unintended displacement of the apparatus, other than together with the bed, is prevented.

Of course, the apparatus can also be arranged differently, for instance it cat be separate from the bed or, by contrast, constitute a fixed whole therewith.

In further elaboration, an assembly according to the invention is characterized by the features of claims 8 and 9.

By mounting the base part of the apparatus on both sides of the bed, the apparatus is suspended from the bed. The floor surface around and under the bed is thus left clear, which for instance simplifies the cleaning of the environment. Moreover, the apparatus thus creates a smaller impression. By mounting the motor onto the base part under the bed it is hidden from view, so that the apparatus acquires an attractive appearance, the more so because the parts projecting outside the bed can be of a smaller and more slender design. After all, these parts do not have to contain the motor.

It is preferred if the motor according to the invention be a linear motor, because the necessary powers can be produced thereby in a simpler manner without requiring the use of complicated, voluminous and costly transmission devices and energizations.

In a further advantageous embodiment, an assembly according to the invention is characterized by the features of claim 11.

Because the swivelling arm can be swung away, the accessibility of the bed is increased and, moreover, the mobility of the user is not impeded thereby by the swivelling arm, which is of importance in particular when the swivelling arm is in or adjacent its second position.

In addition, in a further embodiment an assembly according to the invention is characterized by the features of claim 12.

After at least a part of the apparatus with the swivelling arm has been removed from the bed, the bed can easily be approached, for instance for maintenance or for treatment of the person in the bed. Moreover, with such an embodiment, the portion with the swivelling arm should be installed only if this is necessary. This offers for instance the advantage that in a number of beds a base part can be provided, for which base parts only one part with the swivelling arm is necessary. Moreover, because the apparatus is at least partly removable, the appearance of the bed is improved. This is in particular agreeable to the user, because a stigma of invalidity can thus be removed, prevented or at least reduced.

The invention further relates to an apparatus for movement support for a person moving into or out of the bed, in particular suitable for use in an assembly according to any one of the above embodiments of the present invention.

The invention moreover relates to a method for helping a person into or out of a bed, which method according to the invention is characterized by the features of any of the above embodiments. Furthermore, the method of the present invention is characterized in that the apparatus is at least partly operated by an aid-giver.

Further embodiments of an assembly according to the invention are described in the other subclaims.

It will be understood that an apparatus according to the invention can also be suitable for the movement support of someone who wants to move into or out of a chair, and that an apparatus according to the invention can also be of a (semi-) mobile construction.

Further scope of applicability of the present invention will become apparent from the detailed descriptions given hereinafter. However, it should be understood that the, detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

To explain the invention, an exemplary embodiment of an assembly will be described hereinafter, with reference to the accompanying drawings, wherein.

DESCRIPTION OF THE PREFERRED EMBODIMENTS

Figure 1:
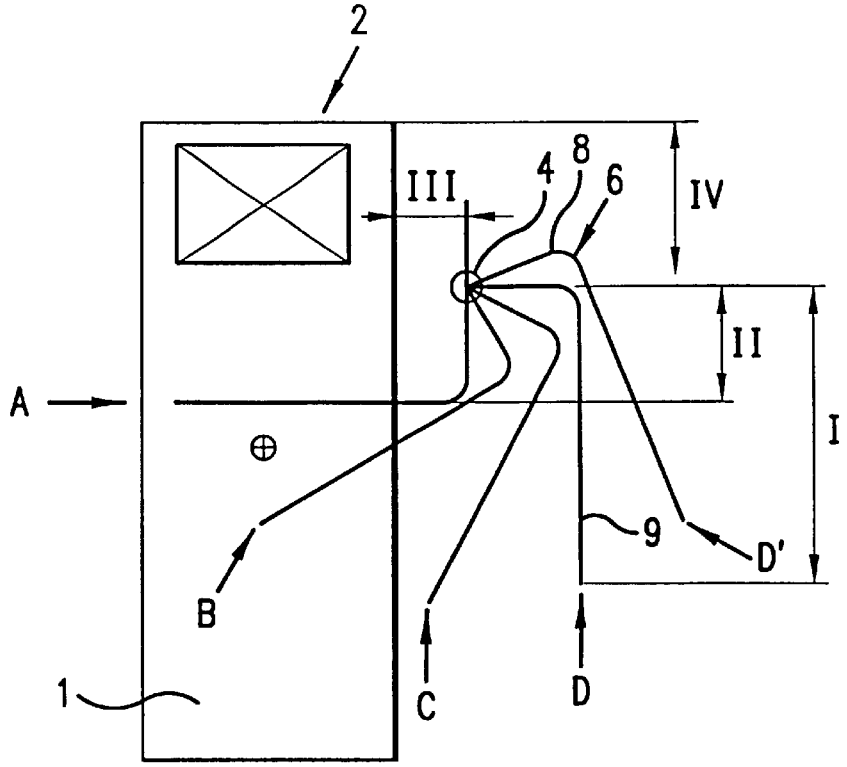
FIG. 1 schematically shows, in top plan view, an assembly according to the invention with a swivelling aim in a number of positions.
Figure 3:
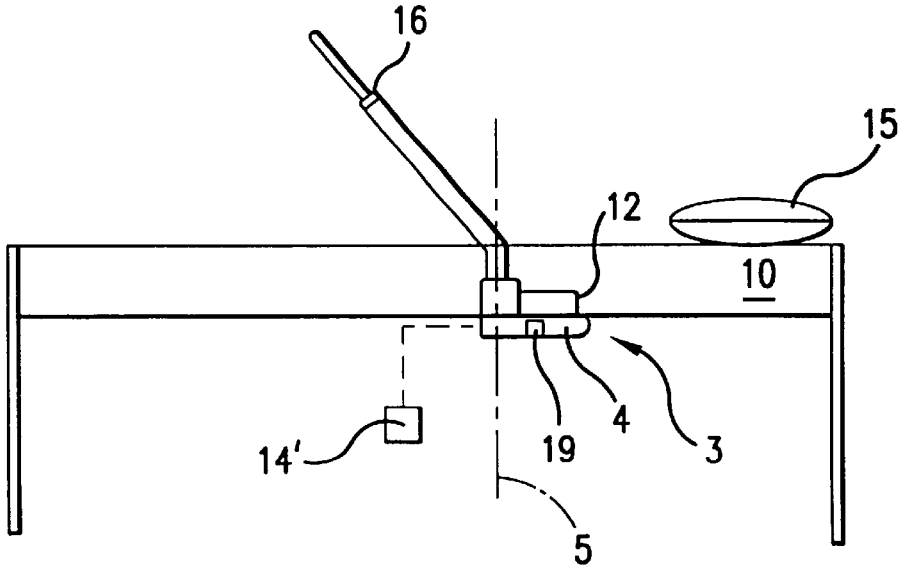
FIG. 3 is a front view of an assembly according to FIG. 1.
Figure 4:
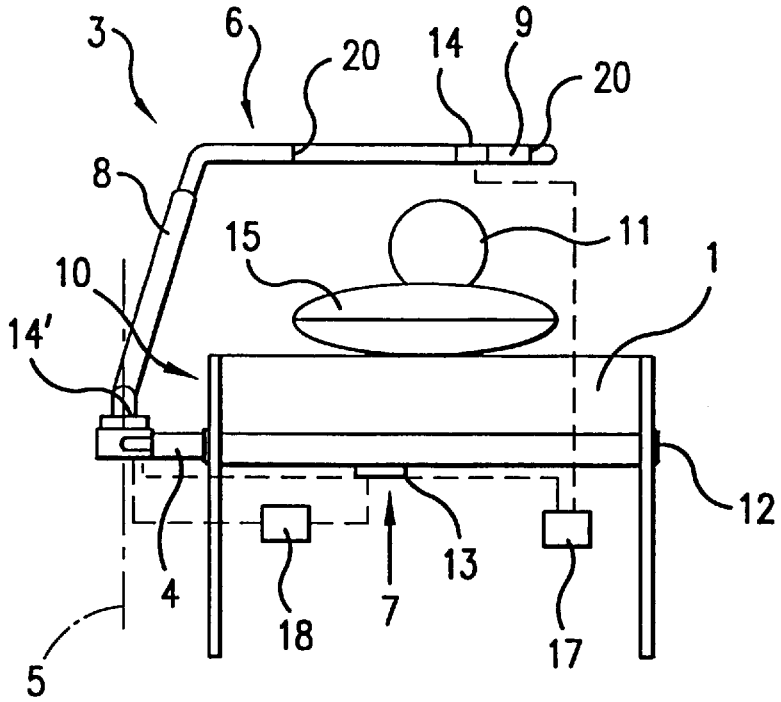
FIG. 4 is a side elevation of an assembly according to FIG. 1.

FIG. 1 is a top plan view of a bed 1 with an apparatus 3 disposed adjacent the head 2 for supporting movements of a user for moving into and out of the bed or during a change of position in bed. In FIGS. 3 and 4, the apparatus 3 is shown in more detail. The apparatus 3 comprises a base part 4, a swivelling arm 6 rotatable relative thereto about an approximately vertically extending axis of rotation 5, and a driving unit 7 for driving the swivelling arm 6.

The swivelling arm 6 comprises a first part 9 which, during use, extends approximately horizontally and is connected via a bent second part 8 to the axis of rotation 5. The swivelling arm is movable between at least two positions. In the first position A, the first part 9 of the swivelling arm extends at least substantially in the width direction of the bed. In the second position D, the first part 9 of the swivelling arm extends at least substantially approximately in the longitudinal direction of the bed. The height of the first part 9 above the bed 1, in the first position A, is such that a user 11 lying in the bed (FIG. 2A) can grip on to it and pull himself up at least by the upper part of the body. The height of the first part 9 above the floor, in the second position D, is such that a user sitting on the bed (FIG. 2D) can comfortably grip an to it and pull himself up to reach a standing position and vice versa, while, moreover, a user standing beside the bed 1 (FIG. 2E) can easily hold on to the first part 9, standing upright in a comfortable manner. As the occasion arises, the height of the first part 9 can be of a settable construction for that purpose, for instance by means of a telescopic portion or by height-adjusting means for the base part 4. Such means can be advantageous in particular when the apparatus is used with a relatively low bed 1.

The base part 4 has a width at least corresponding to the width of the bed 1 and comprises, adjacent the two ends, clamping means 12 whereby the base part 4 can be suspended from the longitudinal edges of the bed 1. On at least one side of the bed 1, the base part 4 projects outside the longitudinal edge 10. In the projecting portion, the swivelling arm 6 is rotatably accommodated. Because the base part 4 is suspended from the bottom side of the bed 1, the environment of the bed, in particular the floor, remains clear of obstacles and the apparatus causes little inconvenience to the user or to aid-givers. The assembly of bed 1 and apparatus 3 can be jointly displaced, while the position of the apparatus 3 relative to the bed 1 always remains the same.

Provided in or under the base part is a motor 13 which, via for instance a clutch disk or a like transmission, transmits a driving force to the swivelling arm 6 for the drive thereof. Preferably, the motor is of the linear type, for instance an electric cylinder, because with such a motor relatively great forces can readily be transmitted without the motor 13 and the other driving means of the driving unit 7 having to be undesirably large. Accordingly, the apparatus can be of a relatively slender construction and, as a result, has a pleasant, little stigmatizing appearance, while, still, sufficient power can continuously be produced for the controlled movement of the swivelling arm 6. The motor 13 is connectable to an internal or external energy source, such as a battery or the mains, preferably both.

Provided on the swivelling arm 6 are operating means 14 for selectively energizing the motor 13. The operating means 14 can for instance comprise an on/off-switch, a speed regulation or a pre-selector switch. In fact, in the base part 4, comparable or other operating means 14' can be provided as well, which may or may not be adapted to remote-control the apparatus 3. The operating means 14, 14' will be returned to hereinafter.

An assembly according to the invention can be used as follows. In the specification, the user is referred to as being male. It will be understood that the apparatus is also suitable for female users.

Figure 2A:
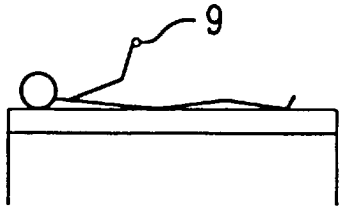
FIGS. 2 A–E show in rear view, five positions during use of an assembly according to FIG. 1.
Figure 2B:
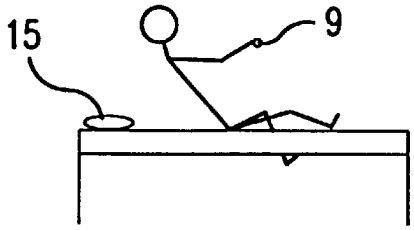
Figure 2C:
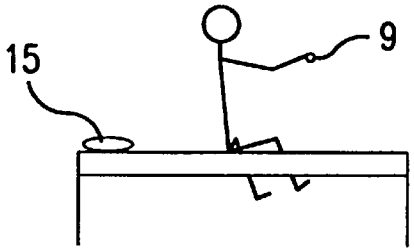
Figure 2D:
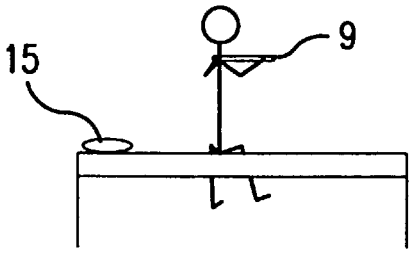
Figure 2E:
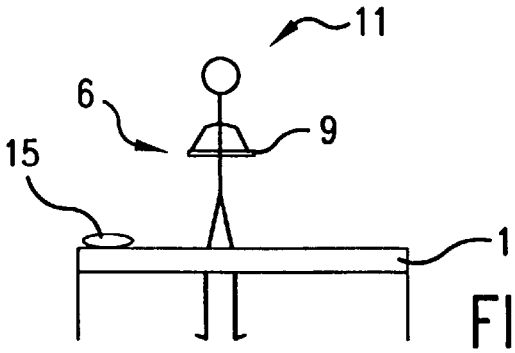

By means of the clamping means 12, the base part 4 is suspended under the bed 1. The swivelling arm 6 can directly be installed together therewith or be coupled thereto at a later stage. The swivelling arm 6 is brought into the second position D. A user whose movements are to be supported places himself, in standing position, between the longitudinal edge 10 of the bed 1 and the first part 9 of the swivelling arm 6, with his back turned approximately towards the bed (FIG. 2E). He grips the first part 9 of the swivelling arm and lowers himself backwards into a sitting position on the edge of the bed 1, while exerting a supporting pulling force on the swivelling arm (FIG. 2D). By means of the operating means 14, he switches on the motor 13. The swivelling arm 6 rotates in the direction of the first position A while passing a number of intermediate positions. During the swivelling movement of the swivelling arm 6, the user can slide backwards in the direction of the head of the bed 1, always or occasionally taking support on the swivelling arm 6. While he draws his legs along onto the bed 1. The driving device 7 of the swivelling arm 6 is designed so that it can constantly take up a pulling force exerted thereon by the user 11. In its rotating movement, the swivelling arm 6 is continuously controlled.

When the swivelling arm 6 has reached the first position A, the rotating movement thereof stops. In that position, the user sits on the bed 1 in an approximately upright position, at some distance from the pillow 15 (FIG. 2C). Then, he can lower himself slowly backwards (FIG. 28) into a lying position, with his head on the pillow 15 (FIG. 2A). During the lowering movement, he can keep holding on to the swivelling arm 6. In the lying position, the user can release the swivelling arm but also grip it again each time, for instance for getting into a sitting position or for shifting his body. As a matter of fact, he can also move the swivelling arm away from him, for instance back into the second position D. In that connection, it is particularly advantageous if operating means 14, 14' can be reached from the lying position or if different types of operating means are present, for instance voice control, remote control or the like.

The user can move from the lying position (FIG. 2A) into the standing position (FIG. 2E) by following the above steps in the reverse order, while he can always pull himself up and hold on to the swivelling arm 6 moving in the direction of the second position D.

Preferably, the swivelling arm 6 is provided, in the bent part 8 thereof, with a universal joint 16, as a result of which the first part 9 can be swung away into, for instance, the first position A and the second position D. Such a universal joint can in fact also be provided in, for instance, the base part 4, so that the entire swivelling arm 6 can be pivoted or swung away, for instance into a position largely under the bed 1. An advantage of swinging away the swivelling arm or a part thereof is that the swivelling arm 6, when not used, does not inconvenience users and aid-givers. Moreover, it renders the appearance of the bed I more agreeable.

The swivelling arm can for instance have the following dimensions; length (I) of first part 9 about 900 mm, length (II) of bent part, at right angles to the first part 9, about 350 mm. distance (III) from pivot 5 to longitudinal edge 10 about 200 mm, and distance (IV) from pivot 5 to head 2 about 900 mm. The first part 9 can extend about 1000–1200 mm above the floor (V). Of course, the dimensions can be adjusted or be adjustable as desired, for instance on the basis of the user and the bed. The dimensions are not essential. For instance, in the case of an adjustable bed, a different height will be advantageous.

The swivelling arm 6 can be provided, preferably on the first pan 9 thereof, with means 20 for coupling thereto a carrying or pulling band (not shown). During use, such a band can for instance be arranged behind the user's back and, coupled to the arm, at least partly support the user and, if necessary, actively bring him into a sitting or, by contrast, lying position, together with the swivelling arm 6.

The driving means 7 can comprise a control unit 17 whereby the movements of the swivelling arm are controlled (semi-) automatically, for instance on the basis of a priorly inputted pattern of movement, which may or may not have been introduced by a self-learning control, or through control on the basis of sensors provided in the apparatus. The control unit 17 can control the swivelling arm 6 for instance intermittently. As a result, the swivelling arm 6 moves at changing speeds, so that the user is each time offered the chance to adjust his sitting, standing or lying position. The swivelling arm can alternately move at different speeds or be stopped between times.

If the operating means 14, 14' comprise speed-regulating means, a user can always select (or cause to be selected) the speed suitable to him, so that the pattern of movement ideal to him can be realized. If the operating means 14, 14' comprise pre-selector possibilities a suitable pattern of movement can each time be selected from a memory by means of the control unit 17. This is advantageous in particular if different persons use the same apparatus or if the person using the apparatus is for instance subject to changing possibilities of movement, for instance as a consequence of a syndrome. Of course, different combinations of operating and control means are possible.

The apparatus preferably comprises safety means 18 for controlling and regulating the pattern of movement of the swivelling arm. For instance, means can be provided for setting a maximum speed of movement of the arm, a maximum moment to be exerted, a maximum angle through which the swivelling arm can move and warning means 19 for detecting for instance a malfunctioning of the apparatus or the base part 4 coming loose.

Figure 5:
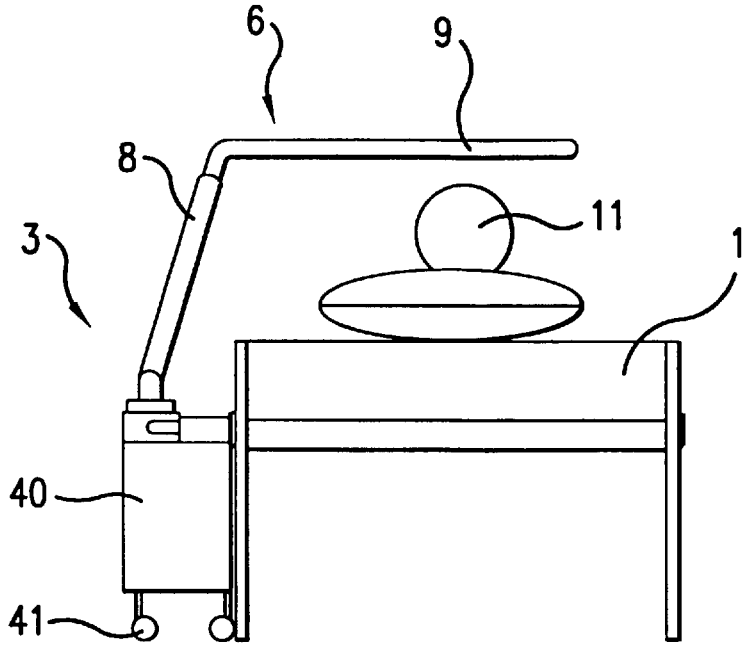
FIG. 5 is a side elevation of an alternative embodiment of an according to the invention.

FIG. 5 shows an alternative embodiment of an assembly according to the invention. In this embodiment, the bass part 40 comprises means for support on the floor, in the embodiment shown braked wheels 41. In this the apparatus can be disposed beside a bed and is particularly mobile. Such an embodiment is for instance particularly advantageous for use in a hospital or nursing home, where different users can share such an apparatus for aiding getting up. Moreover, such an apparatus can be used with a bed having closed or at least insufficiently open side panels.

In particular in an apparatus according to FIG. 5, the movement of the swivelling am can also be obtained at least partly through movement of the apparatus relative to the bed 1, optionally in combination with the movement of the swivelling arm itself relative to the base part. The bed can then serve as a fixed supporting point, for instance through coupling of the apparatus to a bed leg by means of the base part.

In an advantageous embodiment, not shown in the drawing, an apparatus according to the invention is constructed with a detachable swivelling arm, optionally in combination with for instance the driving unit. Thus, in the case of a large number of base parts, one swivelling arm with driving unit can be used, and moreover, placement thereof can be opted for, only if the aid is desired.

The invention is by no means limited to the embodiments as described and shown. Many variations thereto are possible. For instance, the swivelling arm can be of different construction, for instance straight or having more bends. Moreover, the swivelling arm can be of such construction that it can be collapsed or swung out of the way in a controlled manner, for instance by means of a motor. In that connection, an apparatus according to the invention can be constructed so that the primary power transmission of the swivelling arm is reversible and the swivelling arm can be turned over so that the same apparatus can be used on either side of the bed through a simple reversal. Moreover, the length and/or the shape of the swivelling am can be adjusted to, for instance, the bed or the user. In an apparatus according to the invention, a swivelling am can have more than one point of rotation, as a result of which a more complex but, as the occasion arises, more suitable pattern of movement is obtained. It is also possible that the first part 9 of the swivelling arm rotates beyond the position wherein the first part 9 extends at least substantially parallel to the longitudinal direction of the bed. In FIG. 1, this position is indicated by D'. The advantage is that a user has more room for getting out of bed when the first part 9 is in the position D'. Of course, the motor can be designed in different manners and be built in at different positions. As stated, an assembly according to the invention can also relate to an apparatus for aiding getting up and a different supporting means, for instance a chair, a wheelchair, a couch or a bath. In particular when used with a wheelchair or a chair, it is particularly advantageous if the height of the swivelling arm is settable by means of a motor or a like energization. For that purpose, a second pivot can be introduced, approximately at the level of the end of the second part of the swivelling arm remote from the first part, which second pivot extends at right angles to the first pivot. These and many comparable variations are understood to fall within the framework of the invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An assembly comprising a bed and an apparatus for movement support for a person when moving into or out of the bed, wherein the apparatus comprises a base part at least one swivelling arm having an angle, a motor, and positioning means for arranging the apparatus adjacent the bed, wherein said swivelling arm is driven by said motor and said swivelling arm is made of a first part and a second part, at least one of said parts being bent at a location to form said angle, said swivelling arm being joined to the base part and having a free end, the angle in the swivelling arm being positioned closer to the base part than to the free end, said swivelling arm: pivoting relative to the base part about an axis of rotation between at least a first position, in which the free end of the swivelling arm extends at least substantially in a width direction of the bed, and a second position, in which the free end of the swivelling arm extends generally parallel to a longitudinal direction of the bed.

2. The assembly according to claim 1, wherein the swivelling arm comprises operating means which can be operated by the person supported in movement, for controlling the motor for driving the swivelling arm.

3. The assembly according to claim 1, wherein the swivelling arm comprises at least one bend in a plane of the bed between the axis of rotation and the free end so that in the second position the axis of rotation is located closer to the bed than the fee end of the swivelling arm, wherein the free end of the swivelling arm extends approximately along a nearby bed edge at such a distance that a user can stand upright between the bed edge and the free end with his or her hands on the free end.

4. The assembly according to claim 3, wherein the swivelling arm, in top plan view, has an L-shape.

5. The assembly according to claim 1, wherein a driving speed of the swivelling arm is controllable by the person.

6. The assembly according to claim 1, wherein the positioning means are designed for attaching the apparatus to the bed.

7. The assembly according to claim 6, wherein the positioning means are connected to the base part and wherein the base part extends at least partly under a top surface of the bed and comprises clamping means for fixing the base part adjacent two sides of the bed.

8. The assembly according to claim 1, wherein the motor for driving the swivelling arm is connected to the base part and located under the bed.

9. The assembly according to claim 1, wherein the motor for driving the swivelling arm is a linear motor.

10. The assembly according to claim 1, wherein the swivelling arm can be swung away past the second position.

11. The assembly according to claim 1, wherein at least one of said parts of the swivelling arm is removable from the apparatus.

12. The assembly according to claim 1, wherein the arm includes a means for coupling a carrying or pulling band thereto that is extendable around the body of the person to at least partly support the body of the person.

13. An apparatus for movement support for a person when moving into or out of a bed, the apparatus comprising a base part, at least one swivelling arm having an angle, a motor, and positioning means for arranging the apparatus adjacent the bed, wherein said swivelling arm is driven by said motor and said swivelling arm is made of a first part and a second part, at least one of said parts being bent at a location to form said angle, said swivelling arm being joined to the base part and having a free end, the angle in the swivelling arm being positioned closer to the base part than to the free end, said swivelling arm pivoting relative to the base part about an axis of rotation between at least a first position, in which the free end of the swivelling arm can extend at least substantially in a width direction of the bed, and a second position, in which the free end of the swivelling arm can extend generally parallel to the longitudinal direction of the bed.

14. An assembly comprising a lying support or sitting support and an apparatus for movement support for a person when moving into or out of the lying support or sitting support, wherein the apparatus comprises:

a base part;

at least one swivelling arm, said at least one swivelling arm being pivotable relative to said base part about an axis of rotation between at least two positions, said at least one swivelling arm at least partly being at an angle with said axis of rotation;

positioning means provided for arranging the apparatus adjacent the lying support or sitting support so that, during use, at least a first part of said at least one swivelling arm, in a first position, is extendable above a person locatable on the lying support or sitting support, wherein said first part of said at least one swivelling arm extends at least substantially in a width direction of the lying support or sitting support, while said first part of said at least one swivelling arm, in a second position, is extendable along a longitudinal direction of the lying support or sitting support along a person locatable beside the lying support or sitting support; and a motor for driving said at least one swivelling arm throughout a path between said first position and said second position, said at least one swivelling arm transmitting a pulling force to the, person when moving from said first position to said second position and a pushing force when moving from said second position to said first position, said at least one swivelling arm not being drivable to provide a lifting force to lift the person off of the lying support or sitting support.

15. A method for helping a person into or out of a bed, comprising the step of utilizing the assembly of claim 14.

16. An apparatus for movement support for a person when moving into or out of a lying support or a sitting support, said apparatus comprising:

a base part;

at least one swivelling arm, said at least one swivelling arm being pivotable relative to said base part about an axis of rotation between at least two positions, said at least one swivelling arm at least partly being at an angle with said axis of rotation;

positioning means provided for arranging the apparatus adjacent the lying support or sitting support so that, during use, at least a first part of said at least one swivelling arm, in a first position, is extendable above a person locatable on the lying support or sitting support, wherein said first part of said at least one swivelling arm extends at least substantially in a width direction of the lying support or sitting support, while said first part of said at least one swivelling arm, in a second position, is extendable along a longitudinal direction of the lying support or sitting support along a person locatable beside the lying support or sitting support; and a motor for driving said at least one swivelling arm throughout a path between said first position and said second position, said at least one swivelling arm transmitting a pulling force to the person when -moving from said first position to said second position and a pushing force when moving from said second position to said first position, said at least one swivelling arm not being drivable to provide a lifting force to lift the person off of the lying support or sitting support.

* * * * *